US005795084A

United States Patent [19]

Stone et al.

[11] Patent Number: 5,795,084

[45] Date of Patent: *Aug. 18, 1998

[54] METHOD AND APPARATUS FOR LOW COST THERMAL PRINTING

[75] Inventors: James W. Stone, Northbrook; Donald Van Erden, Wildwood, both of Ill.; Paul R. Harding, Ewell, England

[73] Assignee: Illinois Tool Works Inc., Glenview, Ill.

[ * ] Notice: The term of this patent shall not extend beyond the expiration date of Pat. No. 5,649,774.

[21] Appl. No.: 574,571

[22] Filed: Nov. 20, 1995

Related U.S. Application Data

[63] Continuation of Ser. No. 249,785, May 26, 1994, abandoned.

[51] Int. Cl.[6] ..... B41J 33/14

[52] U.S. Cl. ..... 400/225; 400/223

[58] Field of Search ..... 400/223, 225, 400/226, 232, 333, 227; 347/217

[56] References Cited

U.S. PATENT DOCUMENTS

| | | | |
|---|---|---|---|
| 4,033,444 | 7/1977 | Berry | 400/53 |
| 4,453,166 | 6/1984 | Enoto | 346/1.1 |
| 4,595,935 | 6/1986 | Brooks et al. | 400/120 |
| 4,606,661 | 8/1986 | Aldrich | 400/232 |

(List continued on next page.)

FOREIGN PATENT DOCUMENTS

| | | | |
|---|---|---|---|
| 0262506 | 6/1988 | European Pat. Off. | 400/225 |
| 0581403 | 2/1994 | European Pat. Off. | 400/225 |
| 3608360 | 9/1987 | Germany | 400/225 |
| 60-052386 | 3/1985 | Japan | 400/225 |
| 274974 | 12/1986 | Japan | 400/120 HE |
| 19479 | 1/1987 | Japan | 400/224 |
| 63-182172 | 7/1988 | Japan | 400/237 E |
| 6008597 | 1/1994 | Japan | 400/225 |
| 2234710 | 2/1991 | United Kingdom | 400/225 |
| 8910264 | 11/1989 | WIPO | 400/225 |

OTHER PUBLICATIONS

"Ribbon–Saving Technique for APA Printers", IBM Technical Disclosure Bulletin, vol. 31, No. 10, IBM Corp., Mar., 1989.

IBM Technical Disclosure Bulletin, vol. 21, No. 9, Feb., 1979, New York, U.S., p. 3456, R.A. Haus, "High Yield and Low Cost Ribbon Feed".

*Primary Examiner*—Edgar S. Burr
*Assistant Examiner*—Steven S. Kelley
*Attorney, Agent, or Firm*—Dvorak and Traub

[57] ABSTRACT

A method and apparatus for low cost thermal printing in a thermal printer having a software controlled thermal print head that moves in relation to a print ribbon disposed adjacent to a print area of a printed medium. The thermal print head is selectively energized to heat the print ribbon which deposits the ink onto the printed medium as the print head moves in relation to the print ribbon in a print stroke. The cost of printing is decreased by efficient use of the ink on the print ribbon. Between print strokes, the print ribbon is displaced an incremental interval to position an unused portion of the print ribbon for printing on the printed medium during a subsequent print stroke. The precise displacement of the print ribbon may be software controlled based on the detection of indices disposed at spaced intervals along the print ribbon which further increases the efficient usage of ink on the print ribbon. The utilization of ink on the print ribbon is made more efficient by a software controlled generation of an italic or gray shade character font, which require less ink than solid block character fonts. Using less ink on the print ribbon, permits a decrease in the print ribbon displacement interval between print strokes, and also permits some portions of the print ribbon to be overlapped by the print head during a subsequent print stroke. The utilization of ink on the print ribbon may also be made more efficient by mechanical or software controlled linear and lateral shifts of the printed characters during subsequent print strokes, which permits the utilization of ink between areas on the print ribbon where ink was depleted in a previous print stroke.

51 Claims, 4 Drawing Sheets

U.S. PATENT DOCUMENTS

| | | | |
|---|---|---|---|
| 4,611,938 | 9/1986 | Rettke | 400/232 |
| 4,625,216 | 11/1986 | Brooks et al. | 400/120 |
| 4,647,238 | 3/1987 | Okamoto et al. | 400/225 |
| 4,675,698 | 6/1987 | Tsutsumi | 347/217 |
| 4,712,115 | 12/1987 | Tatsumi | 400/233 |
| 4,740,092 | 4/1988 | Applegate et al. | 400/53 |
| 4,760,405 | 7/1988 | Nagira | 400/233 |
| 4,789,260 | 12/1988 | Kobayashi et al. | 400/120 |
| 4,899,170 | 2/1990 | Izumi | 400/120 |
| 4,947,188 | 8/1990 | Nazaki | 400/120 |
| 5,017,028 | 5/1991 | Harding | 400/120 |
| 5,030,021 | 7/1991 | Kamiya | 400/124 |
| 5,064,302 | 11/1991 | Tanuma et al. | 400/54 |
| 5,241,904 | 9/1993 | Kobayashi et al. | 101/93.04 |
| 5,415,481 | 5/1995 | Nakashima | 400/225 |

A LINE OF TEXT
MORE LETTERS

A LINE OF TEXT
MORE LETTERS

A LINE OF TEXT
MORE LETTERS

A LINE OF TEXT
MORE LETTERS

A LINE OF TEXT
MORE LETTERS

A LINE OF TEXT
MORE LETTERS

A LINE OF TEXT
MORE LETTERS

A LINE OF TEXT
MORE LETTERS

A LINE OF TEXT
MORE LETTERS

A LINE OF TEXT

TEXT LABEL

TEXT LABEL

TEXT LABEL

TEXT LABEL

TEXT LABEL

TEXT LABEL

TEXT LABEL

TEXT LABEL

TEXT LABEL

TEXT LABEL

METHOD AND APPARATUS FOR LOW COST THERMAL PRINTING

This application is a continuation of application Ser. No. 08/249,785, filed May 26, 1994, now abandoned.

FIELD OF THE INVENTION

The present invention generally relates to thermal printing and, more specifically, to a novel method and apparatus for low cost thermal printing in a thermal printer having a thermal print head that moves in relation to a print ribbon disposed adjacent to a print area of a printed medium, wherein the thermal print head is selectively energized to heat the print ribbon which deposits the ink in an intelligible arrangement onto the printed medium as the print head moves in relation to the print ribbon.

BACKGROUND OF THE INVENTION

Thermal printers have many applications, one of which is printing one or more lines of the text or other information on a printed medium having a plurality of print areas. In some applications, the same or different information is printed on the different print areas. For example, thermal printers are often employed to print the same expiration date or other information on flexible wrappers and packaging for perishable food items and other articles. For printing purposes, a plurality of these packages or wrappers, each having a designated print area for the printed expiration date or information, may be in the form of a unitary printed medium that is fed to the thermal printer for printing, and later processed for packaging or shipping. Thermal printers may also be used to print information directly on a packaged article or on the article itself. Other applications for print thermal printers include printing information on a semi-rigid printed medium for example, a wallet size plastic card fed to the thermal printer for printing. Print quality requirements also vary from application to application. In the expiration date example given above, for instance, a high resolution text may not be required, and for economical reasons, a legible, low resolution text is often paramount. In other applications, like the wallet size plastic card application, it is desirable to print an aesthetic, high resolution text, graphics, or bar codes. These are only a few examples of the many applications of thermal printers.

Thermal printers generally comprise a thermal print head with an array of heating elements that are movable in relation to a print ribbon having a thermally sensitive ink layer disposed adjacent to a print area of the printed medium. The print ribbon typically comprises a thin ribbon substrate having a layer of thermally sensitive ink disposed on a surface thereof. Printing occurs during a print stroke during which the heating elements of the print head are selectively energized to heat portions of the print ribbon which deposit thermally sensitive ink onto the print area of the printed medium as the print head moves in relation thereto. Heating the print ribbon, however, causes portions of the ink layer to be removed or depleted from the ribbon substrate corresponding to areas that were heated by the print head. Reheating an area of the print ribbon depleted of ink during a previous print stroke does not result in any further deposition of ink onto the printed medium, and therefore ink depletion areas of the print ribbon may not be reused by the print head. In order for the thermal printer to print on another print area of the printed medium in a subsequent print stroke the print ribbon must be moved to position a non-ink depleted area of the ribbon adjacent to the next print area of the printed medium.

In the past, the print ribbon has been positioned to move the ink depletion areas away from a next print area of the printed medium, and to position an inked area of the print ribbon adjacent to the next print area of the printed medium. Re-positioning the print ribbon in this manner however leaves substantial inked portions of the print ribbon unused which results in wasted print ribbon and unnecessary costs. For example, after each print stroke, inked portions of the print ribbon often remain between ink depletion areas corresponding to characters printed during the print stroke. Further, arbitrary re-positioning of the print ribbon after each print stroke to ensure that the print head does not over-lap an ink depletion area during a subsequent print stroke, may result in failure to print with other useful inked areas of the print ribbon. Inefficient use of the thermally sensitive ink on the print ribbon results in increased print ribbon consumption and decreased productivity while replacing a used print ribbon which further increases costs. Print ribbon costs are characterized by the cost of the print ribbon substrate and the cost of the thermally sensitive ink layer disposed on the print ribbon substrate. The cost of the ink is a substantial element of print ribbon cost. More efficient use of the ink on the print ribbon will decrease print ribbon usage, which will result in substantial cost savings.

In view of the discussion above, there exists a demonstrated need for an advancement in the art of a thermal printing.

It is therefore an object of the present invention to provide a novel method and apparatus for thermal printing.

It is also an object of the present invention to provide a novel method and apparatus for a thermal printer that reduces print costs by efficient utilization of a thermally sensitive ink disposed on a print ribbon. Efficient use of the print ribbon results in less print ribbon consumption, and in fewer production interruptions, such as delays for ribbon changes, thereby reducing printing costs.

It is also an object of the present invention to provide a novel method and apparatus for a thermal printer that uses a print ribbon with an series of detectable indices spaced along a surface thereof.

It is another object of the present invention to provide a novel method and apparatus for a thermal printer that uses software and/or mechanical means to control displacement of the indexed or non-indexed print ribbon an incremental interval after one or more print strokes based on the number of indices detected or based on recorded movement of the ribbon. In one embodiment, the print ribbon is displaced an incremental interval that permits the print head to utilize adjacent areas of the print ribbon during subsequent print strokes with some over-lap of the ink depletion areas of the print ribbon. In an alternative embodiment, the displacement of the print ribbon is increased to prevent the print head from over-lapping ink depletion areas during a subsequent print stroke to improve print quality.

It is another object of the present invention to provide a novel method and apparatus for a thermal printer that uses software to control displacement of the indexed print ribbon based on a number of print strokes that occur during the detection of two adjacent indices. The number of print strokes counted between two adjacent indices may be compared to a reference number, for example the number of print strokes counted between two previous indices.

It is further object of the present invention to provide a novel method and apparatus for a thermal printer having a software controlled print head that generates different character fonts that decrease usage of the ink on the indexed print ribbon and therefore permit more characters to be printed with the indexed print ribbon. In one embodiment, the print head generates an italic character font. In another embodiment, the print head generates a gray shade font. In both embodiments the print head may over-lap portions of the print ribbon with ink depletion areas formed during a subsequent print stroke without adversely effecting print quality.

It is a further object of the present invention to provide a novel method and apparatus for a thermal printer having a software controlled print head that laterally shifts characters during a subsequent print stroke to utilize ink on a portion of the print ribbon between ink depletion areas formed during a previous print stroke.

It is yet a further object of the present invention to provide a novel method and apparatus for a thermal printer having a software controlled print head that selects an appropriate character font and laterally shifts characters during a subsequent print stroke, and a software controlled means for displacing an indexed print ribbon an incremental interval after a print stroke to reduce print costs. Laterally shifting printed characters distributes the work load of the print head which increases the life expectancy of the print head.

Accordingly, the present invention is directed toward a novel method and apparatus for low cost thermal printing in a thermal printer having a software controlled thermal print head that moves in relation to an indexed print ribbon with a thermally sensitive ink layer disposed adjacent to a printed medium, such as a package for a product. The thermal print head comprises a linear array of heating elements that are selectively energized to heat the print ribbon which deposits ink onto the printed medium as the print head moves in relation to the print ribbon in a print stroke. In two specific embodiments, the heating elements may be either resistive or light-emitting elements. The cost of printing may be decreased by efficient use of the ink on the print ribbon. Between print strokes or after the completion of a number of print strokes, the print ribbon is displaced an incremental interval to position an unused portion of the print ribbon adjacent to a next print area of the printed medium. The displacement of the print ribbon is also software controlled. The amount of specific displacement may be controlled by the ribbon feeding means, without the use of indices on the ribbon, or may be based on the detection of discontinuities or indices disposed at intervals along the print ribbon. In one embodiment, the indices are a series of relatively reflective areas or glossy stripes formed along a matte surface of the ink layer, which are detected by sensing a light reflected from the print ribbon. The relatively matte areas may contain the same, more, or less ink than adjacent areas. The utilization of ink on the print ribbon is also made more efficient by selecting or generating an appropriate character font with the print head. In one embodiment, the print head generates a slanted character font which creates an ink depletion area on the print ribbon that may be closely stacked or nestled next to an ink depletion area caused by a subsequent print stroke. Certain italic character fonts are also comprised of thin lines that tend to obscure small areas where no ink is deposited due to the print head over-lapping ink depletion areas of the print ribbon during a subsequent print stroke. In an alternative embodiment, the print head generates a gray shade character font or a font formed of a plurality of parallel lines. The thin lined, slanted line, and shaded fonts require less ink than do some other types of fonts and therefore use less ink on the print ribbon during the print stroke. Also, use of these fonts reduces the degradation of visual image quality which may otherwise result from the ink saving measures. By reducing the areas of ink depletion on the print ribbon, the print ribbon displacement interval between print strokes may be decreased, and some portions of the print ribbon may be over-lapped by the print head during a subsequent print stroke thereby reducing print costs without adversely effecting print quality. The utilization of ink on the print ribbon may also be made more efficient by laterally shifting the printed characters during subsequent print strokes in addition to selecting an appropriate character font and controlling the incremental displacement interval of the print ribbon as discussed above. Lateral shifting of characters during subsequent print strokes permits the utilization of ink between areas on the print ribbon where ink was depleted in a previous print stroke. Lateral shifting of characters also permits the print ribbon displacement interval to be decreased and further permits some portions of the print ribbon to be over-lapped by the print head during subsequent print strokes without adversely effecting print quality. Lateral character shifting and generation of the character fonts is accomplished by selectively energizing the heating elements of the print head during the print stroke, and these functions are readily controlled by software, for the purpose of reducing print costs. However, the shifting may also be accomplished by mechanical means.

These and other objects, features and advantages of the present invention will become apparent upon consideration of the following Detailed Description of the Invention with the accompanying drawings.

DETAILED DESCRIPTION OF THE INVENTION

Figure 1B:
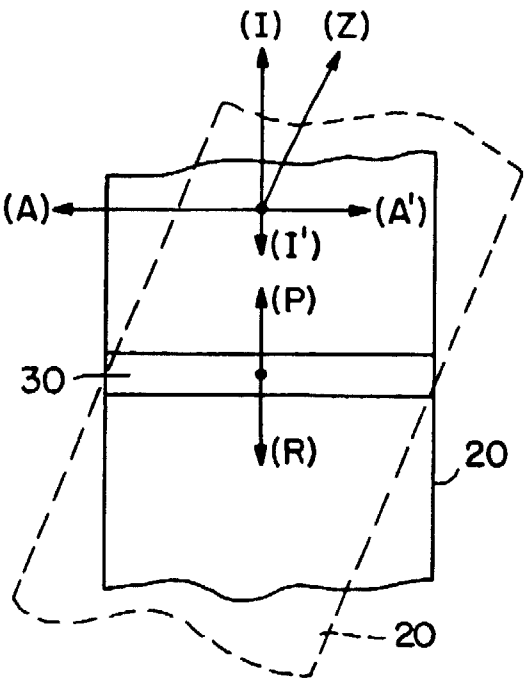
FIG. 1*b* is partial top view of the thermal printer assembly of FIG. 1.
Figure 1A:
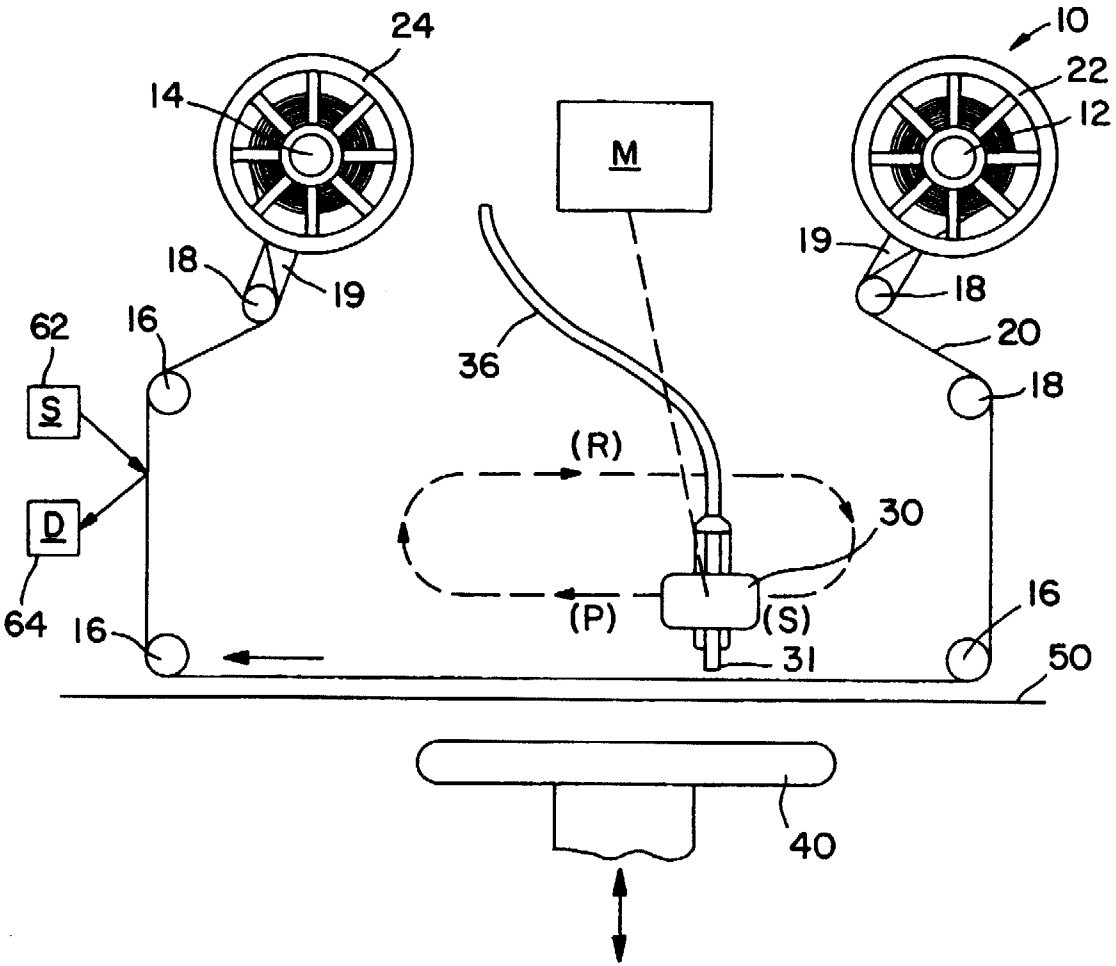
FIG. 1*a* is a partial side view of a thermal printer assembly usable for practicing the present invention.

FIG. 1 is a partial side view of a flat-bed thermal printer assembly 10 usable for practicing the present invention, and generally comprising a thermally sensitive print ribbon 20 movably disposed between a movable thermal print head 30 and a print head support plate 40. Flat-bed thermal printers are useful for printing on a flexible and a non-flexible printed medium, such as a flexible wrapping material or a plastic printed medium usable for wallet size cards. In FIG. 1, a flat printed medium 50 on which information is to be printed by the thermal printer 10, is movably disposed between the print ribbon 20 and the support plate 40. The print ribbon 20 generally comprises a ribbon substrate, made for example, of a Mylar material, having a thermally sensitive ink layer disposed on one surface of the ribbon printed medium. In one embodiment, the thermal print ribbon 20 is wound about a ribbon supply reel 22 rotatably disposed on a supply spindle 12, and is transferrable, in incremental displacement intervals, to a rotatable take-up reel 24 disposed on a take-up spindle 14. The print ribbon is oriented so that the ink layer is adjacent the printed medium 50 and the Mylar substrate is adjacent the print head 30. The print ribbon 20 may be guided by one or more ribbon guide rollers 16 to accurately position the ribbon 20 in relation to the print head 30 and the printed medium 50. A ribbon tensioning roller 18 may also be disposed on a spring biased arm 19 to maintain a proper tension on the ribbon 20 as it is fed from the supply reel 22 to the take-up reel 24. A motor, in one embodiment a stepper motor, may be used to drive the take-up reel 24 and feed the print ribbon 20 in synchronization with the operation of the print head 30 as further discussed below. The motor may, if desired, be more precisely controlled by a software programmable micro-controller or other processing means. The present invention is also applicable to thermal printers that print information on a flexible printed media fed around a rubber roller or platen. In both flat-bed and platen type printers, the printed medium is positioned in relation to the printer ribbon 20 and print head 30 by printed medium feeding means not shown in the drawing. The printed medium feeding means may comprise, for example, a motor driven conveyor assembly that feeds the printed medium 50 in a synchronized relation to the printing function of the thermal printer assembly 10. In one embodiment, the function and timing of the printed medium feeding means is more precisely controlled by a software programmable micro-controller or other processing means. A feedback loop may provide information to the feeding means for real time control, or calibration of the ribbon movement.

Figure 2:
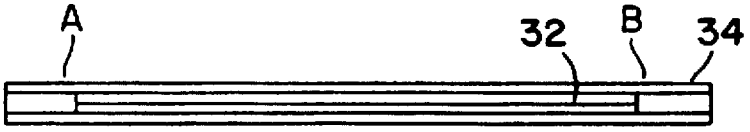
FIG. 2 is an end view of one embodiment of a thermal print head of FIG. 1 having a linear array of thermal heating elements.

FIG. 2 is an end view of the thermal print head 30, which in one embodiment comprises a linear array of heating elements 32 disposed on a distal end 34 of the print head 30 over a segment, between points A and B, of the print head 30. In one embodiment, the segment may range from one to four inches. However, the print head is not limited in size depending upon the application. The heating elements 32 may be optical, laser, or electrical resistive heating elements, not shown in the drawing, arranged in a density of approximately 203 heating elements per inch. Other embodiments, however, may in general comprise a two dimensional matrix of heating elements arranged in any density, which as practical matter, will depend on the print resolution required for a particular application. In the case of resistive heating elements, the resistive heating elements 32 are individually actuated or energized by an electric voltage applied across each resistive element which causes the resistive heating element to generate heat. In one embodiment, a voltage generating circuit or driver, not shown in the drawing, is coupled to the resistive heating elements 32, and applies a voltage to the resistive heating elements 32 in response to an electrical signal transmitted through one or more signal wires connected to the voltage generating circuit. Typically, the signal wires form a ribbon 36 that is connectable to the print head 30. In one embodiment, the signals transmitted through the signal wires of the ribbon 36 are modulated or multiplexed by a multiplexing circuit to reduce the number of signals and accordingly the number of wires necessary to individually control the heating elements 32. The multiplexed signal must of course be de-multiplexed by a de-multiplexing circuit before the signals are applied to the voltage generating circuit. The electrical signals for energizing the heating elements 32 are generated under the control of a software programmable micro-controller or other processing means as further discussed below. In another embodiment, the ambient temperature of the print head 30 is increased by a preheating means. Preheating the print head 30 increases the temperature of an energized resistive heating element without increasing a temperature differential between the energized heating element and the print head thereby reducing stress and prolonging the life of the print head 30. The efficiency and life expectancy of the print head may also be increased by controlling the heat output of a selected resistive heating element based on the ambient temperature of a localized area near the selected resistive heating element. More specifically, the voltage applied to and, accordingly, the heat output of a selected heating element may be dependent on how recently the selected resistive heating element was energized, and on how recently neighboring resistive heating elements were energized. This may readily be done with a software programmable micro-controller or other processing means.

Before printing information on the printed medium 50 in a printing step, the printed media 50 is positioned in relation to the thermal printer assembly 10. More specifically, the printed medium feeding means positions the printed medium 50 in relation to the print ribbon 20 and the print head 30 so that information may be printed in a designated print area on the printed medium 50 during the print step. In one embodiment of the flat-bed type thermal printer 10, the printed medium support 40 is positioned adjacent to the printed medium 50 by mechanical or electromechanical means to support the printed medium 50 during the printing step in which ink from the ribbon 20 is deposited on the printed medium. In platen type thermal printers, a rubber roll functions as a printed medium support analogous to the printed medium support plate 40 of the flat-bed type printer. In some applications, it may also be necessary to secure the printed medium 50 to prevent movement of the printed medium 50 during the printing step which may result in smearing of the printed information or other improper printing. In one embodiment of the flat-bed type thermal printer, the printed medium 50 is secured in relation to the printer ribbon 20 and the print head 30 by clamping means, not shown in the drawing. The clamping means may comprise a mechanically or electro-mechanically actuated arm that clamps the printed medium 50 in a fixed position in relation to the printer ribbon 20 and the print head 30 so that ink may be accurately deposited on the print area of the printed medium 50. The clamping means may form an integral part of the printed medium support plate 40. In an embodiment of the platen type thermal printer, the printed medium may be secured in relation to the thermal printer 10 by fixing the angular and spatial position of the rubber roller in relation to the print ribbon 20 and the print head 30.

Figure 3:
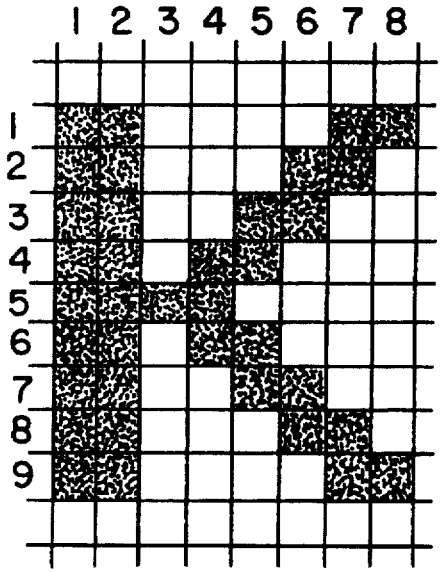
FIG. 3 is one embodiment of a printed character comprised of a matrix of picture elements.

In the printing step, the thermal printer assembly 10 of the present invention prints information on the printed medium 50 during a print stroke in which the print head 30 is moved along a print path (P) from a starting position (S), in relation to a fixed print ribbon 20 and a fixed and properly supported printed medium 50. In one embodiment, the print stroke is initiated in response to a que or signal from the printed medium feeding means. During the print stroke, the linear array of heating elements 32 are selectively energized to apply thermal energy to a non-inked side of the print ribbon 20 causing the thermally sensitive ink disposed on the opposing side of the print ribbon 20 to be selectively deposited as a series of dots or picture elements called "pixels" that lie along a row or column of the printed medium 50. The print head 30 is then re-positioned, and another row or column of pixels is deposited on the printed medium 50 adjacent to the previously deposited row or column of pixels. By selectively energizing the resistive heating elements 32 and printing a series of consecutive rows or columns, any desired information may be printed on a printed medium. FIG. 3 is one embodiment of a printed character comprised of a matrix of pixels having 8 vertical columns and 9 horizontal rows. It is not necessary that the pixels have a square shape and, in fact, pixels having other shapes may, in some applications, form characters having greater resolution, and be more economical. Resolution quality generally varies inversely with increased pixel size. It may also be advantageous to move the print head 30 at an angle in relation to the printed information or text. In one embodiment, a stepper motor moves the print head 30 an incremental displacement interval, and the print head 30 which then selectively applies heat to the print ribbon 20 which deposits ink along the row or column of the printed medium 50. The stepper motor then moves the print head 30 another incremental displacement interval, and the process is repeated until the print stroke is complete. In an alternative embodiment, the print head 30 prints a series of consecutive rows or columns during a continuous movement until the print stroke is complete. In one embodiment, the print head 30 is moved at a rate of between approximately 80 and 120 mm per second, although the print stroke rate may be increased or decreased. As ink is deposited on the printed medium 50 during the print stroke, an ink depletion area is formed on the print ribbon 20 corresponding with the areas of the print ribbon that are subject to heating by the print head 30.

After the print stroke, the print head 30 is returned to the starting position in a return stroke along a return path (R) that may coincide with the print path (P) during which time the print head 30 may be moved away from the print ribbon 20 to avoid unnecessary contact therewith. Before the next print stroke, and possibly during the return stroke, the printed medium 50 is moved or re-positioned by the printed medium feeding means in relation to the thermal printer 10 for printing on another, or the next, print area of the printed medium 50, after which time the printed medium feeding means sends another signal to the thermal printer to initiate the next print stroke. In one embodiment, the printed medium support 40 is moved away from the printed medium 50 before the printed medium 50 is re-positioned. During the re-positioning of the printed medium 50, or at least before the next print stroke, the print ribbon 20 is advanced or moved an incremental displacement interval so that an unused portion of the print ribbon 20 is positioned adjacent to the next print area of the printed medium 50. In one embodiment, the print ribbon is advanced a precise displacement interval after each print stroke, and in another embodiment, the print ribbon is advanced after multiple strokes as discussed below. Figure 1*b* is a partial top view of the print ribbon 20 and the print head 30, wherein the arrows (P) and (R) illustrate the directions the print head 30 travels along the print and return paths. Figure 1*b* also illustrates the displacement of the print ribbon 20 in relation to the print path. In one embodiment, the print ribbon 20 is displaced an incremental interval in a linear direction (I) or (I') which may be along the print path (P) or the return path (R). In another embodiment, the print ribbon 20 is displaced an incremental interval in a lateral direction (A) or (A') which is transverse to the print path (P) and the return path (R). In yet another embodiment, the print ribbon 20 is displaced in both a lateral and linear direction which is at an angle in relation to the print path, for example (Z). The direction of displacement of the print ribbon 20 in relation to the print path may be controlled to optimize ink usage. For example, block letters may be nestled close together by displacing the print ribbon at an angle as discussed above. Lateral and linear displacement of the print ribbon 30 may be performed by a ratchet and pawl mechanism alone or in combination with a motor driven roller. In a platen type thermal printer, the print head may be held stationary along a radial of the rubber roller and the print ribbon and printed medium are both moved an incremental displacement interval in relation to the print head. Platen type thermal printers may also be more precisely controlled by a software programmable micro-controller or processing means. In one embodiment, ribbon would be retracted a fixed amount after an image impression. The positioning of the print ribbon 20 may be more precisely controlled by detecting one or more print ribbon parameters and controlling print ribbon displacement based on the parameters as further discussed below.

In another embodiment, the printing occurs as the print ribbon 20 and printed medium 50 are moved in relation to a fixed print head. The print ribbon 20 may be advanced by the take-up reel 24 and, in an alternative, the print ribbon 20 may be shifted a lateral, linear or combination of lateral and linear incremental displacement intervals. Shifting may be done alone or in combination with advancement by the take-up reel 24. Other embodiments may shift the head in a lateral or linear direction in combination with the advancement of the print ribbon 20.

Figure 4:
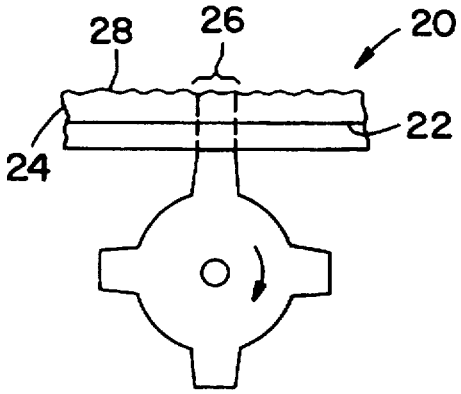
FIG. 4 is a partial side view of a wax based print ribbon having a printed medium, an ink layer, and an index disposed on a surface of the ink layer.
Figures 5A, 5B:
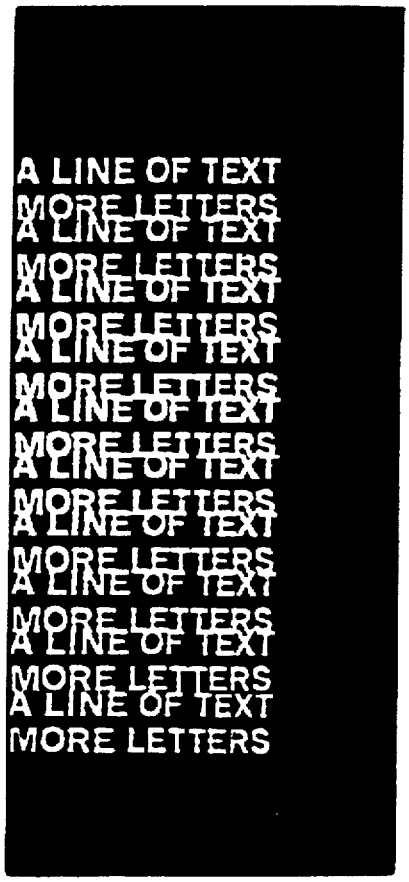
FIG. 5*a* is an embodiment of the present invention in which two lines of text having a block character font are repeatedly printed on a printed medium during multiple print strokes.
FIG. 5*b* is a partial section of an ink ribbon usable in the thermal printer of FIG. 1, and illustrates ink depletion on the ribbon after printing the two lines of text in FIG. 5*a*.

FIG. 5*a* is an embodiment of the present invention in which two lines of text having a block or non-italic type character font is repeatedly printed on a printed medium. Each two lines of text are printed during a single print stroke and therefore Figure 5*a* is a printed medium which has been subject to multiple print strokes. Figure 5*b* is a section of a print ribbon usable in a thermal printer of the present invention, and illustrates a print image or the ink depletion on the print ribbon after printing the printed medium in FIG. 5*a*. FIG. 5*b* illustrates how print ribbon ink may be more efficiently deposited on the printed medium by precisely controlling the incremental displacement interval of the print ribbon 20 after each print stroke. In one embodiment, the incremental displacement interval of the print ribbon 20 between print strokes is measured and controlled by a software programmable micro-controller or processing means to more efficiently utilize the ink on the print ribbon 30. In another embodiment, the displacement of the print ribbon 20 is measured and controlled by detecting a series of bar or line indices disposed at regular intervals along the print ribbon 20. The indices may, in general, comprise any series of irregularities or discontinuities spaced at regular intervals along either side of the print ribbon 20 so long as the irregularities or discontinuities are detectable by a sensing means. For example, FIG. 4 is side view of a wax type print ribbon 20 having a ribbon substrate 22, and a wax based ink layer 24 with a series of indices in the form of bar shaped reflective zones 26. In wax based inks having more than 50 percent wax, the reflective zones 26 may be formed by partially melting the wax based ink at regularly spaced intervals. The localized melting tends to even out any peaks in the ink surface, resulting in relatively reflective lines. For example, a roller having heated projectiles may be rolled over the backside of the print ribbon 20. The matte surface 28 in these wax based inks results from evaporation of a solvent after the ink layer 24 is applied to the ribbon printed media 22 during a manufacturing process. The solvent in the ink forms a gas in the form of diffused bubbles which escape from the ink layer through outer surfaces of the ink layer 24 and evaporate giving rise to the matte surface 28 as the ink layer 24 dries. Other indexing schemes may also be used. For example, the print ribbon 20 may be indexed by printing dull or flat colored stripes disposed on the inked or non-inked side of the ribbon printed medium 22. The stripes or indices may also be detectable fluorescent areas, or other areas which differ from surrounding areas and which may be visible or invisible to the naked eye.

The present invention is also applicable to multistrike-type ribbons wherein multiple ink layers are formed on a ribbon substrate. Each print area of the multistrike print ribbon may be used for multiple print strokes or operations wherein only one of the multiple ink layers is deposited on the printed medium during each print stroke. Some ribbons deposit a single layer of ink in response to variable amounts of heat applied to the ribbon during each print stroke or operation. Regardless of the mechanism used for depositing ink, multistrike print ribbons may be controlled with or without indices as discussed above with respect to wax-based ribbons.

FIG. 1 illustrates a sensing means comprising a signal source 62 and a signal detector 64. For example the signal source 62 may be a light source that is directed toward the surface of print ribbon 20 having detectable indices, and the signal detector 64 may be a light detector that responds to a change in light reflected from the surface of the print ribbon 20 having detectable indices. These signal changes result from the effects of the print ribbon surface discontinuities on the incident light from the source 62. More specifically, the matte surface 28 of the print ribbon tends to scatter incident light thereby reducing the amount of reflected light detectable by the signal detector 64. The reflecting zones 26, however, are highly reflective and increase the amount of light detectable by the signal detector 64. The response of the signal detector 64 to changes in the detected light may be converted into ribbon displacement signals that are proportional to the incremental displacement interval of the print ribbon 20. The ribbon displacement signals may be used to determine the displacement interval of the print ribbon 20, and to control when to start and stop the take-up reel 24 which controls the incremental displacement interval of the print ribbon 20. In one embodiment, the indices 26 are spaced at intervals of approximately one-tenth of an inch and a software programmable micro-controller or processing means is used to precisely control the incremental displacement interval of the print ribbon 20 by starting and stopping a motor that drives the take-up reel 24 based upon print ribbon displacement signals. In an alternative embodiment, the indices 26 are spaced at much greater intervals, for example, 36 inches. Under this alternative ribbon incrementing scheme, the software programmable processing means controls the motor to increment the print ribbon 20 over a fixed displacement interval between indices 26. Meanwhile, the processing means also counts the number of times the print ribbon 20 has been incremented between two indices. The print ribbon increment count is then compared to a reference, for example, a print ribbon increment count obtained for a preceding pair of indices, or a reference related to an expected ribbon displacement interval. Based on this comparison, the processor means may increase or decrease the print ribbon incremental displacement interval by controlling the motor. In this manner the incremental displacement interval of the print ribbon may be precisely controlled to improve print quality, or to more efficiently utilize the ink on the print ribbon 20 and thereby reduce print costs.

Figure 7:
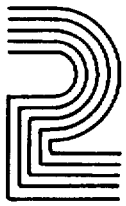
FIG. 7 is an embodiment of the present invention in which a block type character font is formed by a plurality of parallel lines.
Figures 6A, 6B:
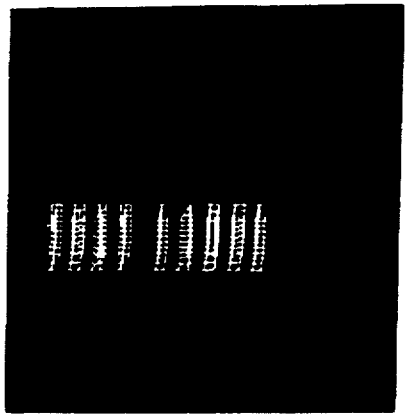
FIG. 6*a* is an embodiment of the present invention in which a line of text having an italic character font is repeatedly printed on a printed medium during multiple print strokes.
FIG. 6*b* is a partial section of an ink ribbon usable in the thermal printer of FIG. 1, and illustrates ink depletion on the ribbon after printing the two lines of text in FIG. 6*a*.

The utilization of the ink on the print ribbon may be increased by selecting or generating an appropriate character font in addition to controlling the incremental displacement interval of the print ribbon as discussed above. Some character fonts require less ink than others, and therefore appropriate character fonts selection will reduce the ink depletion areas on the print ribbon. By reducing the ink depletion areas on the print ribbon, the print ribbon displacement interval may be decreased, and some portions of the print ribbon may be over-lapped by the print head during subsequent print strokes. For example, FIG. 6*a* is an embodiment in which a line of text having an italic character font, is repeatedly printed on a printed medium. FIG. 6*b* is a section of a print ribbon that illustrates a print image or the ink depletion on the print ribbon after printing the printed medium in FIG. 6*a*. The italic character font of FIG. 6 is comprised of slanted character lines which permit lines of text to be printed much closer to one another on the print ribbon, without adversely effecting print quality in subsequent print strokes. The italic characters printed on the printed media of FIG. 6*a* have some small areas where no ink is deposited as a result of over-lapping use by the print head of ink depletion areas on the print ribbon. These italic character fonts, however, are comprised of lines that are more narrow than the lines that comprise block letter fonts, and these more narrow lines tend to obscure these small blank ink areas in the italic character. In another embodiment, the print head generates a gray shade character font, in addition to controlling the incremental displacement interval of the print ribbon, to improve the efficiency of ink deposition on a printed medium. For example, a ½, ⅓ or ¼ tone gray shade character font decreases the amount of ink deposited on the printed medium 50 without substantially degrading the line of printed text and, accordingly, decreases the ink depletion area on the print ribbon 20. These partially depleted ink areas on the print ribbon 20 may be partially overlapped by the print head 30 during a subsequent print stroke without adversely effecting print quality in subsequent print strokes. FIG. 7 is an example of a gray shade, block character font comprised of a plurality of parallel lines. The parallel line approach to gray shading produces a clear, well defined character and is particularly well suited for block character although it may also be applied to other character fonts. The parallel lines may be made more or less dense to darken or lighten, respectively, the shade of the character. Other character font shading methods, for example, a checker board arrangement, may also be used. The print head 30 may be readily controlled by a software programmable micro-controller or processing means to print the various characters, fonts, and gray shades discussed above.

Figure 8:
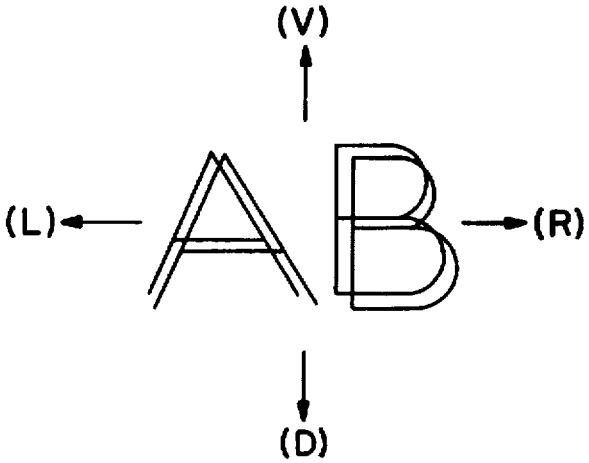
FIG. 8 is a partial section of a print ribbon usable in the present invention, and illustrates ink depletion on the print ribbon when lateral character shifting, and print ribbon displacement are performed in subsequent print strokes.

The utilization of the ink on the print ribbon may be further increased by laterally shifting the printed characters during the print stroke in subsequent lines of text, in addition to selecting an appropriate character font and controlling the incremental displacement interval of the print ribbon as discussed above. Lateral shifting of characters in subsequent print strokes permits the utilization of ink between areas on the print ribbon where ink was depleted in a previous print stroke. Lateral shifting of characters also permits the print ribbon displacement interval between print strokes to be decreased, and further permits some portions of the print ribbon to be over-lapped by the print head during subsequent print strokes. For example, FIG. 8 illustrates depletion on a partial section of a print ribbon in which two characters "A B" are printed twice, in separate print strokes. A lateral character shift in the subsequent print stroke shifts the subsequently printed characters to one side or the other, indicated by the horizontal arrows (R) and (L), of the character printed in the first print stroke. FIG. 8 also illustrates a print ribbon that has been displaced an incremental interval, either up or down, between print strokes, indicated by the vertical arrows (U) and (D). In practice, one or more entire lines of printed text are laterally shifted in subsequent print strokes, and the print ribbon is displaced an incremental distance after a print stroke as discussed above. In another embodiment, characters are first laterally shifted to the right several times corresponding to several print strokes to utilize the ink between the characters, for example between "A" and "B". Then, after the ink between characters has been depleted, the characters may be shifted up or down by displacing the print ribbon an incremental interval as discussed above. Lateral character shifting is readily controlled by software and therefore many other combinations of lateral character shifting and print ribbon displacement exist. For example, after one print stroke the text may be shifted in one direction, and then after the next print stroke, the text may be shifted in the opposite direction. In one embodiment, lateral shifting is on the order of one or more millimeters in either direction although it may be more or less. Lateral shifting does effect the location of the printed text on the printed medium, but this effect is usually inconsequential since the shifting is on the order of a few millimeters. In another embodiment, the character font may be laterally shifted by modifying the character spacing in each line of text. For example, character separation may be alternately increased and decreased in subsequent print strokes. Character spacing may also be used in combination with the lateral character shifting and print ribbon displacement as discussed above. In practice, lateral shifting and character spacing are accomplished by energizing different heating elements in the print head during the print stroke, and this may be readily controlled by a software programmable micro-controller or processing means as discussed above. Laterally shifting of characters by energizing different heating elements of the print head also tends to distribute the work load of the print head which has a benefit of increasing the service life of the print head as well as reducing print costs.

According to the present invention, it is also possible to laterally shift and linearly shift a print image formed by the print head 30 on the print ribbon 20 by software control of the heating elements. Depending on the application, the software may be used to control the print head 30 to improve the utilization of ink in a given ribbon area without actually advancing the ribbon. In one embodiment, multiple print strokes may be performed without incrementing the print ribbon 20 by laterally or linearly shifting the print image formed on the print area of the print ribbon after each print stroke. After the multiple print strokes are complete, the print ribbon 20 is advanced in one of the directions discussed above to position a new, unused print area of the print ribbon 20 adjacent to the print path for the next print stroke or series of print strokes. The lateral and linear shifting of the print image on the print ribbon 20 by software control of the heating elements 34, is applicable to the embodiments that use a non-indexed print ribbon and to embodiments that use an indexed print ribbon.

The foregoing is a description enabling one of ordinary skill in the art to make and use the preferred embodiments of the present invention. It will be appreciated by those skilled in the art that there exists variations, modifications and equivalents to the embodiments disclosed herein. The present invention therefore is to be limited only by the scope of the appended claims.

What is claimed is:

1. A thermal printer for depositing a thermally sensitive ink from a single use print ribbon onto a print area of a printed medium, the print ribbon having the thermally sensitive ink disposed adjacent to the print area of the printed medium, the thermal printer comprising:

a print head having a linear array of individual heating elements selectively energizable to generate heat, the individual heating elements disposed adjacent to the print ribbon;

means for moving the print head in a print stroke, wherein the print head is moved in relation to the print ribbon and the printed medium, and during the print stroke, the individual heating elements are selectively energized to heat a first portion of the print ribbon which deposits thermally sensitive ink onto the print area of the printed medium and forms a print image on the print ribbon; and a first motor for displacing the print ribbon an incremental displacement interval after a print stroke to position a second portion of the print ribbon adjacent to the first portion of the print ribbon, the second portion having at least one segment where the ink has been removed by a prior print stroke, so that the second portion of the print ribbon may be selectively heated by the print head during a subsequent print stroke, the first and second portions being followed by subsequent portions, the resulting print image having gaps due to the segments having removed ink.

2. The thermal printer of claim 1, further comprising means for mechanically positioning the print head along a print path and a return path.

3. The thermal printer of claim 1, further comprising means for moving the print ribbon at an angle in relation to the motion of the print head.

4. The thermal printer of claim 1, further comprising software programmable processing means for controlling the first motor.

5. The thermal printer of claim 1, wherein the individual heating elements are resistive heating elements.

6. The thermal printer of claim 1, wherein the individual heating elements are light generating means.

7. The thermal printer of claim 1, further comprising means for incrementally repositioning the print ribbon in a lateral and linear direction in relation to a path of the print head.

8. The thermal printer of claim 7, wherein the heating elements of the print head are software controlled to laterally shift characters printed in a subsequent print stroke in relation to characters printed in a previous print stroke, to utilize thermally sensitive ink on the first portion of the print ribbon not used in the previous print stroke.

9. The thermal printer of claim 7, wherein the heating elements of the print head are software controlled to time delay characters printed in subsequent print strokes in relation to characters previously printed, to achieve a linear shift of the printed characters.

10. The thermal printer of claim 1, further comprising means for incrementally repositioning the print ribbon in a lateral direction in relation to a path of the print head.

11. The thermal printer of claim 10, wherein the heating elements of the print head are software controlled to laterally shift characters printed in a subsequent print stroke in relation to characters printed in a previous print stroke, to utilize thermally sensitive ink on the first portion of the print ribbon not used in the previous print stroke.

12. The thermal printer of claim 10, wherein the heating elements of the print head are software controlled to time delay characters printed in subsequent print strokes in relation to characters previously printed, to achieve a linear shift of the printed characters.

13. The thermal printer of claim 1, further comprising means for incrementally repositioning the print ribbon in a linear direction in relation to a path of the print head.

14. The thermal printer of claim 13, wherein the heating elements of the print head are software controlled to time delay characters printed in subsequent print strokes in relation to characters previously printed, to achieve a linear shift of the printed characters.

15. The thermal printer of claim 13, wherein the heating elements of the print head are software controlled to laterally shift characters printed in a subsequent print stroke in relation to characters printed in a previous print stroke, to utilize thermally sensitive ink on the first portion of the print ribbon not used in the previous print stroke.

16. The thermal printer of claim 1, the print ribbon further comprising a ribbon substrate having a surface with a layer of thermally sensitive ink disposed thereon, and a series of detectable indices disposed at spaced intervals along the surface of the print ribbon, the detectable indices being discontinuities formed in the layer of thermally sensitive ink, the sensing means arranged and constructed to detect the indices, wherein movement of the print ribbon is related to the detection of the indices.

17. The thermal printer of claim 16, wherein the thermally sensitive ink layer exhibits a relatively rough surface, and wherein the detectable indices are a series of relatively smooth areas formed on the rough surface of the layer of thermally sensitive ink, the smooth areas containing substantially the same amount of ink as the rough surface area.

18. The thermal printer of claim 16, further comprising a sensing means for detecting the indices on the print ribbon, the sensing means includes a light source directed toward the surface of the print ribbon, and a light detector that detects and responds to a change in light reflected from the surface of the print ribbon.

19. The thermal printer of claim 16, wherein the heating elements of the print head are software controlled to print a character font on a print area of the printed medium, and wherein the first motor displaces the indexed print ribbon an incremental displacement interval after a print stroke so that the print head may heat the second portion of the indexed print ribbon during a subsequent print stroke, wherein the second portion of the indexed print ribbon is adjacent to the first portion of the print ribbon.

20. The thermal printer of claim 17, wherein relatively rough surfaces and smooth areas are optically relatively non-reflective and reflective, respectively.

21. The thermal printer of claim 17, wherein the software programmable processing means controls the first motor to displace the print ribbon an incremental displacement interval based on a print stroke count between adjacent detectable indices detected by the sensing means.

22. The thermal printer of claim 17, further comprising a feed back means to actively control the ribbon displacement based on sensed information relating to ink depletion.

23. The thermal printer of claim 17, further comprising a feed back means to control the ribbon displacement based on sensed information relating to a comparison of actual ribbon movement and expected ribbon movement, wherein the sensed information is utilized to correct movement of the ribbon.

24. The thermal printer of claim 19, wherein the heating elements of the print head print one or more elements of a character font on a print area of the printed medium, and wherein the first motor displaces the indexed print ribbon an incremental displacement interval after a print stroke so that the print head may heat the second portion of the indexed print ribbon during a subsequent print stroke, wherein the second portion of the indexed print ribbon is adjacent to the first portion of the print ribbon, and the second portion of the indexed print ribbon partially overlaps the first portion of the indexed print ribbon.

25. The thermal printer of claim 19, wherein the heating elements of the print head are software controlled to laterally shift characters printed in a subsequent print stroke in relation to characters printed in a previous print stroke, to utilize thermally sensitive ink on the first portion of the print ribbon not used in the previous print stroke.

26. The thermal printer of claim 19, wherein the heating elements of the print head are software controlled to time delay characters printed in subsequent print strokes in relation to characters previously printed, to achieve a linear shift of the printed characters.

27. The thermal printer of claim 24, wherein the printed font comprises thin, slanted characters.

28. The thermal printer of claim 24, wherein the printed font comprises characters having a plurality of substantially parallel lines.

29. The thermal printer of claim 24, wherein the printed font comprises block type characters printed in shaded tones.

30. The thermal printer of claim 1, wherein the printed font comprises thin, slanted characters.

31. The thermal printer of claim 1, wherein the printed front comprises characters having a plurality of substantially parallel lines.

32. The thermal printer of claim 1, wherein the printed font comprises block type characters printed in shaded tones.

33. A method of printing with a thermal printer having a print head with a linear array of individual heating elements selectively energizable to heat a single use print ribbon having a thermally sensitive ink which is deposited onto a print area of a printed medium, the print ribbon having a layer of the thermally sensitive ink disposed adjacent to the print area of the printed medium, the method comprising steps of:

moving the print head stroke, in relation to the print ribbon and the print area of the printed medium;

selectively energizing the individual heating elements to heat a first portion of the indexed print ribbon which deposits thermally sensitive ink onto the print area of the print area of the printed medium during the print stroke;

displacing the print ribbon an incremental displacement interval after a print stroke to position a second portion of the print ribbon adjacent to the first portion of the print ribbon such that the second portion of the print ribbon has at least one segment where the ink has been removed by a prior print stroke, so that the second portion of the print ribbon may be heated by the heating elements of the print head during a subsequent print stroke; and displacing the print ribbon to expose a new ribbon section to the printing process, these steps being repeated, the resulting print image having gaps due to the segments having removed ink.

34. The method of claim 33, wherein the print ribbon has a ribbon substrate having a surface with a layer of thermally sensitive ink disposed thereon, further comprising a step of forming a series of detectable discontinuities at spaced intervals along a surface of the layer of thermally sensitive ink, wherein the detectable discontinuities are detectable indices.

35. The method of claim 33, comprising steps of controlling the heating elements of the print head with software to print a character font on a print area of the printed medium, and displacing the indexed print ribbon an incremental displacement interval after a print stroke so that the print head may heat the second portion of the indexed print ribbon during a subsequent print stroke, wherein the second portion of the indexed print ribbon is adjacent to the first portion of the print ribbon.

36. The method of claim 34, wherein the layer of thermally sensitive ink has a relatively rough surface, further comprising a step of forming a series of relatively smooth areas on the rough surface of the layer of thermally sensitive ink, wherein the relatively smooth areas are the detectable indices.

37. The method of claim 34, wherein the sensing means for detecting the indices on the print ribbon includes a light source directed toward a surface of the print ribbon, and a light detector, further comprising steps of directing the light source toward the surface of the indexed print ribbon, and detecting and responding to a change in light reflected from the surface of the indexed print ribbon with the light detector.

38. The method of claim 34, wherein the series of discontinuities are formed by localized heating of the print ribbon.

39. The method of claim 34, further comprising the steps of detecting the detectable indices, counting the number of indices which move along with displacement of the print ribbon, and actively controlling the displacement of the print ribbon based upon the detected indices.

40. The method of claim 34, further comprising the steps of detecting the detectable indices, measuring actual ribbon displacement by counting the number of indices which move along with displacement of the print ribbon, comparing the actual measured displacement with an expected ribbon displacement reference, and periodically correcting the ribbon displacement interval such that the actual measured displacement agrees substantially with the expected ribbon displacement.

41. The method of claim 37, further comprising steps of counting print strokes of the print head, and displacing the print ribbon an incremental displacement interval based on the print strokes counted between selected indices detected on the indexed print ribbon.

42. The method of claim 33, further comprising steps of controlling the heating elements of the print head to print a character font comprised of a plurality of substantially parallel lines on a print area of the printed medium, and displacing the print ribbon an incremental displacement interval after a print stroke so that the print head may heat the second portion of the print ribbon during a subsequent print stroke, wherein the second portion of the print ribbon is adjacent to the first portion of the print ribbon, and the second portion of the print ribbon partially overlaps the first portion of the print ribbon.

43. The method of claim 33, further comprising steps of controlling the heating elements of the print head to print a font having thin, slanted characters on a print area of the printed medium, and displacing the print ribbon an incremental displacement interval after a print stroke so that the print head may heat the second portion of the print ribbon during a subsequent print stroke, wherein the second portion of the print ribbon is adjacent to the first portion of the print ribbon, and the second portion of the print ribbon partially overlaps the first portion of the print ribbon.

44. The method of claim 33, further comprising steps of controlling the displacement of the print ribbon with a software programmable processing means, and controlling the heating elements of the print head to laterally shift characters printed in a subsequent print stroke in relation to characters printed in a previous print stroke, to utilize thermally sensitive ink on the first portion of the print ribbon not used in the previous print stroke.

45. The method of claim 33, further comprising steps of controlling the displacement of the print ribbon with a software programmable processing means, and controlling the heating elements of the print head to linearly shift characters printed in a subsequent print stroke in relation to characters printed in a previous print stroke to utilize thermally sensitive ink on the first portion of the print ribbon not used in a previous print stroke, and displacing the indexed print ribbon an incremental displacement interval after two print strokes so that the print head may heat the second portion of the print ribbon during a subsequent specific number of print strokes.

46. The method of claim 33, further comprising the steps of controlling the displacement of the print ribbon with a software programmable processing means, and controlling the heating elements of the print head to linearly and laterally shift characters printed in a subsequent print stroke in relation to characters printed in a previous print stroke, to utilize thermally sensitive ink on the first portion of the print ribbon not used in a previous print stroke.

47. The method of claim 33, further comprising the steps of controlling the displacement of the print ribbon with a software programmable processing means, controlling the print head to utilize a second group of heating elements in a subsequent print stroke, in relation to a previous print stroke which utilized a first group of heating elements, thereby alternating heating elements for succeeding print strokes, to utilize thermally sensitive ink on the first portion of the print ribbon not used in a previous print stroke, and displacing the print ribbon an incremental displacement interval after the print strokes in which alternate heating elements are utilized so that the print head may heat the second portion of the print ribbon during a subsequent specific number of print strokes.

48. The method of claim 33, further comprising the steps of controlling the displacement of the print ribbon with a software programmable processing means, and controlling the heating element of the print head to alternate on and off during movement of the print head in a linear direction in a print stroke, such that each individual heating element is prevented from depositing ink during off periods, to save thermally sensitive ink on the print ribbon for subsequent print strokes.

49. The method of claim 33, further comprising the step of generating a grey shaded font by effecting incomplete ink transfer at one or more areas of the print ribbon.

50. A method of printing with a thermal printer having a print head with a plurality of individual heating elements selectively energizable to heat a single use print ribbon having a thermally sensitive ink which is deposited onto a print area of a printed medium, the print ribbon having a layer of the thermally sensitive ink disposed adjacent to the print area of the printed medium, the method comprising steps of:

causing relative movement of the print head in relation to the print ribbon and the print area of the printed medium from a start position to an end portion for a first printing operation;

selectively energizing a first set of individual heating elements to heat a first portion of the print ribbon which deposits thermally sensitive ink onto the print area of the printed medium;

causing relative movement of the print head in relation to the print ribbon to replace the print head at the start position;

causing relative movement of the print ribbon with respect to the printed medium after said first printing operation to position adjacent the printed medium a second portion of the print ribbon such that said second portion of the print ribbon has at least one segment where the ink has been removed by said prior printing operation so that said second portion of the print ribbon may be heated by the heating elements of the print head during a subsequent printing operation;

causing relative movement of the print head in relation to the print ribbon and the print area of the printed medium from a start position to an end position for a second printing operation;

selectively energizing a second set of individual heating elements to heat said first and second portions of the print ribbon which deposits thermally sensitive ink onto the print area of the printed medium; and these steps being repeated, the resulting print image having gaps due to the segments having removed ink.

51. A method of printing with a thermal printer having a print head with a linear array of individual heating elements selectively energizable to heat a single use print ribbon having a thermally sensitive ink which is deposited onto a print area of a printed medium, the array extending laterally with respect to the direction of movement of the print head, the print ribbon having a layer of the thermally sensitive ink disposed adjacent to the print area of the printed medium, the method comprising steps of:

moving the print head in a first stroke, in relation to the print ribbon and the print area of the printed medium;

selectively energizing a first set of individual heating elements to heat a first portion of the print ribbon which deposits thermally sensitive ink onto the print area of the printed medium during the first print stroke;

moving the print head in a subsequent stroke, in relation to the print ribbon and the print area of the printed medium;

displacing the print ribbon after the subsequent print stroke to position a second portion of the print ribbon adjacent to the first portion of the print ribbon such that the second portion of the print ribbon has at least one segment where the ink has been removed by the prior print strokes, so that the second portion of the print ribbon may be heated by the heating elements of the print head during further print strokes;

selectively energizing a second set of individual heating elements to heat again the first portion of the print ribbon which deposits thermally sensitive ink not deposited in the previous print stroke onto the print area of the printed medium; and these steps being repeated, the resulting print image having gaps due to the segments having removed ink.

* * * * *